US006588303B1

(12) United States Patent
Walsh

(10) Patent No.: US 6,588,303 B1
(45) Date of Patent: Jul. 8, 2003

(54) ANTI-ROTATION DEVICE FOR FASTENER

(75) Inventor: Leonard M. Walsh, Forestville, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 10/066,103

(22) Filed: Feb. 1, 2002

(51) Int. Cl.[7] ..... B25B 9/00
(52) U.S. Cl. ..... 81/13; 81/125.1; 81/177.6
(58) Field of Search ..... 81/13, 55, 487, 81/177.7–177.9, 125.1; 411/119, 120

(56) References Cited

U.S. PATENT DOCUMENTS

| | | | | | |
|---|---|---|---|---|---|
| 896,458 | A | * | 8/1908 | Morgan | 81/125.1 |
| 1,316,398 | A | * | 9/1919 | Steininger | 81/177.6 |
| 2,102,897 | A | | 12/1937 | Holhut | |
| 2,704,005 | A | * | 3/1955 | Clayson | 81/177.6 |
| 3,349,650 | A | * | 10/1967 | Wright | 81/13 |
| 4,191,235 | A | | 3/1980 | Davis | |
| 4,730,960 | A | * | 3/1988 | Lewis et al. | 81/177.6 |
| 4,739,680 | A | | 4/1988 | Ecker et al. | |
| 5,188,008 | A | | 2/1993 | States | |
| 5,797,300 | A | * | 8/1998 | Fairbanks | 81/177.6 |
| 5,954,466 | A | | 9/1999 | Coffey et al. | |
| 6,412,374 | B1 | * | 7/2002 | Hsieh | 81/177.6 |
| 2002/0110437 | A1 | * | 8/2002 | Kirimoto | 411/119 |

* cited by examiner

*Primary Examiner*—D. S. Meislin
(74) *Attorney, Agent, or Firm*—Brian J. Hamilla

(57) ABSTRACT

An anti-rotation device for a fastener, comprising: a first coupling for engaging a first fastener; a second coupling for engaging a feature located near the first fastener; and a flexible connection between the first and second couplings. The flexible connection limits rotation of the first coupling relative to the second coupling. The anti-rotation device could be part of a kit which also includes a holder. The holder comprises: a first opening for receiving the first coupling and a second opening for receiving the second coupling. The spacing between the first and second openings corresponds to the distance between the first and second fasteners. The anti-rotation device allows the operator to tighten or loosen a third fastener corresponding to said first fastener without manually engaging the first fastener.

19 Claims, 3 Drawing Sheets

ANTI-ROTATION DEVICE FOR FASTENER

TECHNICAL FIELD

The present invention relates to an anti-rotation device for a fastener. Specifically, the present invention relates to a device that limits the rotation of a fastener when tightening or loosening the corresponding fastener.

BACKGROUND OF THE INVENTION

A gas turbine engine has several modules. The first module, in terms of axial flow path, is the compressor section. Ambient air enters the engine through the compressor section. The compressor section pressurizes the air.

The second module is the combustion section. The combustion section introduces fuel to the air previously compressed by the compressor section. The combustion section then ignites the mixture.

The third module is the turbine section. The turbine section extracts energy from the exhaust produce by the compressor section. The turbine section is coupled to the compressor section so that the exhaust drives the compressor.

Finally, the air exits the engine as thrust.

FIG. 1 is a perspective view of part of a gas turbine engine 10. The drawing shows a first module, such as a compressor section 11, adjacent a second module, such as a combustion section 13. The cases of these sections 11, 13 have corresponding flanges 15, 17 which abut and define a joint 19.

Fasteners, such as 12-point bolts 21 and nuts 23, extend through aligned openings in the flanges 15, 17 to seal the joint 19. FIG. 1 displays the conventional method of tightening the bolts 21 and nuts 23. The typical method requires the operator first to manipulate both a manual wrench W and a pneumatic impact wrench I. The manual wrench W engages the nut 23 and the pneumatic wrench I engages the bolt 21. After actuating the impact wrench I, the operator prevents rotation of the nut 23 by applying torque to the wrench W. As the bolt 21 and nut 23 tighten, the operator must apply an increasing amount of torque to the wrench W. The operator replaces the impact wrench I with another manual wrench W to provide the final torque to the fasteners. Now, the operator must apply torque to both manual wrenches W.

Loosening the bolts 21 and nuts 23 is similar. The operator engages the nut 23 with the wrench W and the bolt 21 with the second manual wrench W. The operator applies torque to both manual wrenches to loosen the fasteners slightly. Then operator then replaces the second manual wrench W with the impact wrench I. The operator then actuates the impact wrench I to remove the loosened bolt 21. The operator applies the greatest amount of torque to the wrench W during initial loosening of the fasteners. As the bolt 21 and the nut 23 loosen further, the operator can apply a decreasing amount of torque to the wrench W.

The operator must apply a typical torque of between approximately 30 and approximately 1000 in-lbs. Since the joint 19 may have up to 160 pairs of bolts 21 and nuts 23, the possibility of operator fatigue does exist. Since the engine 10 may have at least four joints 19, the possibility of fatigue becomes even more apparent.

DISCLOSURE OF THE INVENTION

It is an object of the present invention to provide a new and improved anti-rotation device.

It is a further object of the present invention to provide an ergonomically beneficial antirotation device.

It is a further object of the present invention to provide an anti-rotation device that reduces operator fatigue.

It is a further object of the present invention to provide an anti-rotation device that does not require the application of torque by the operator.

It is a further object of the present invention to provide an anti-rotation device that allows the operator to tighten or loosen a pair of fasteners with only one hand.

It is a further object of the present invention to provide an anti-rotation device that increases the speed that an operator can assemble or disassemble an assembly secured together by multiple fasteners.

These and other objects of the present invention are achieved in one aspect by an antirotation device for a fastener. The fastener comprises: a first coupling for engaging a first fastener; a second coupling for engaging a feature located near the first fastener; and a flexible connection between the first and second couplings. The flexible connection limits the rotation of the first coupling relative to the second coupling.

These and other objects of the present invention are achieved in another aspect by kit for preventing rotation of a fastener. The kit includes an anti-rotation device and a holder. The antirotation device includes a first coupling for engaging a first fastener; and a second coupling for engaging a second fastener located a distance from the first fastener. The second coupling is flexibly connected to the first coupling. The holder includes: a first opening for receiving the first coupling and a second opening for receiving the second coupling. The spacing between the first and second openings corresponds to the distance between the first fastener and the second fastener. The second coupling limits rotation of the first coupling.

These and other objects of the present invention are achieved in another aspect by a method of preventing rotation of a fastener. The method comprises the steps of: placing a first coupling on a first fastener; placing a second coupling on a feature located near the first fastener; flexibly connecting the first and second couplings; tightening or loosening a third fastener corresponding to the first fastener; and limiting rotation of the first coupling while tightening or loosening the third fastener.

BRIEF DESCRIPTION OF THE DRAWINGS

Other uses and advantages of the present invention will become apparent to those skilled in the art upon reference to the specification and the drawings, in which.

BEST MODE FOR CARRYING OUT THE INVENTION

Figure 1:
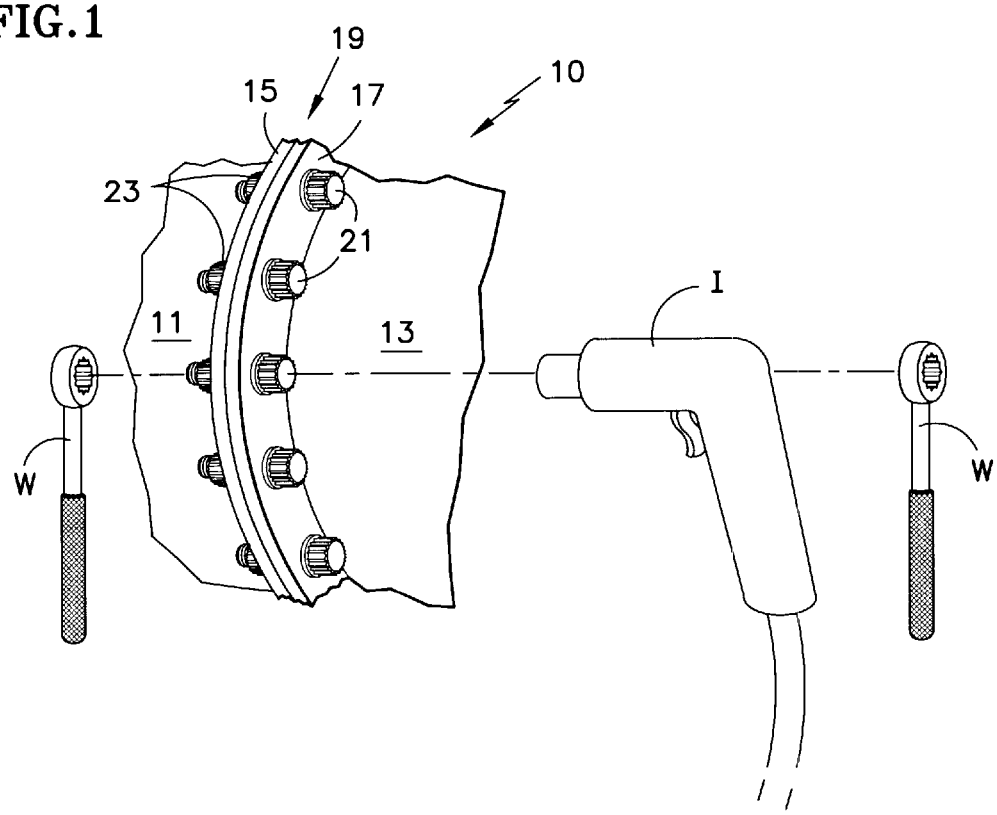
FIG. 1 is a perspective view of a part of a gas turbine engine and the conventional tools used to tighten and loosen the fasteners on the case flanges.
Figure 2:
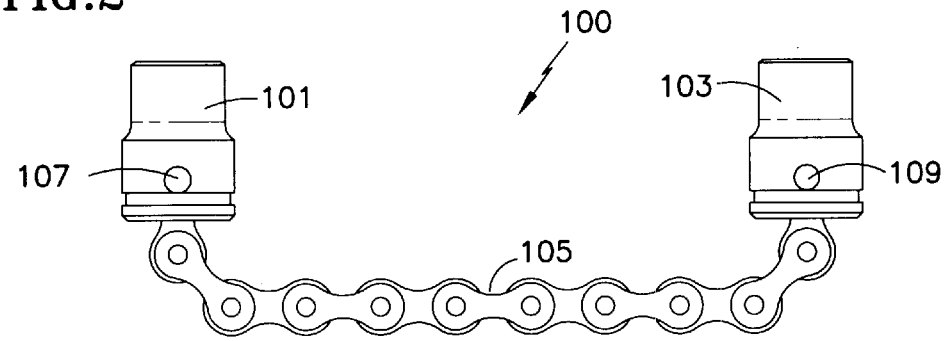
FIG. 2 is a side view of one alternative embodiment of an anti-rotation device of the present invention.
Figure 3:
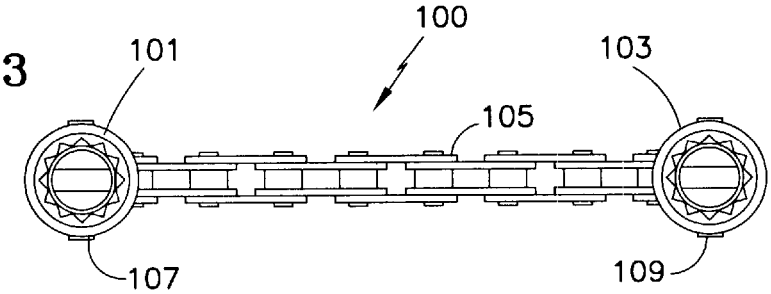
FIG. 3 is a plan view of the anti-rotation device of FIG. 2.

FIGS. 2 and 3 provide, respectively, a side and a top view of one alternative embodiment of the present invention. The figures display an anti-rotation device 100. The antirotation device 100 includes a first coupling 101, a second coupling 103, and a flexible connection 105 between the couplings 101, 103.

The first coupling 101 engages a first fastener. Thus, the first coupling 101 must correspond to the shape of the first fastener. Since 12-point bolts 21 and nuts 23 secure the flanges 15, 17 of the engine 10 together, the figures represent the first coupling 101 as a 12-point socket. Depending upon the type of fastener, however, the first coupling 101 could have any suitable shape. For example, the first coupling 101 could have a hex head (not shown), socket head (not shown), Torx drive head (not shown) or a pin-type head (not shown).

The first coupling 101 could be made from any suitable material. For example, the first coupling 101 could be metallic and have a black oxide coating. Other materials, such as chrome plated steel, non-spark beryllium, or non-magnetic materials could be used.

The second coupling 103 engages a feature located near the first fastener. Preferably, the feature is a second fastener identical to the first fastener. Therefore, the second coupling 103 is also a 12-point socket.

Figure 4:
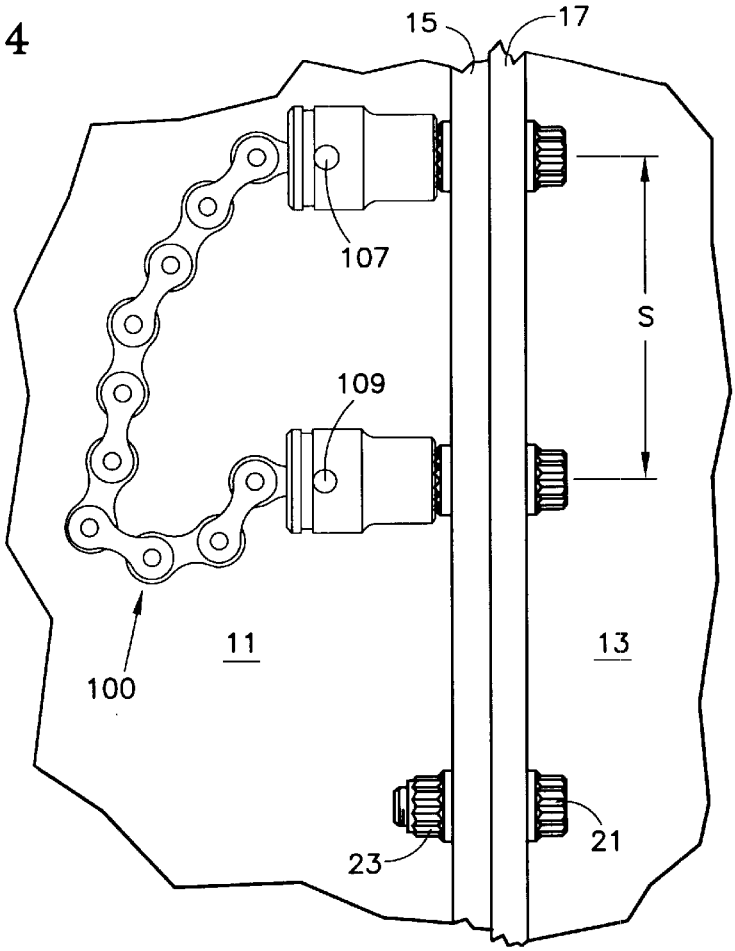
FIG. 4 is a side view of a section of an engine case showing the anti-rotation device of FIG. 2 in position.

As seen in FIG. 4, the second fastener is near, and preferably adjacent, the first fastener. Adjacent fasteners have a spacing S therebetween.

If using a feature other than the second fastener, the second coupling 103 must have a corresponding shape on the engine 10 to accept the feature. For example, the operator could mount the second coupling 103 to fasteners on an adjacent flange (not shown) or on an auxiliary port (not shown). Alternatively (not shown), this feature could be located on the impact wrench I. Finally, the second coupling 103 could be permanently mounted (not shown) to the impact wrench I.

Similar to the first coupling 101, the second coupling 103 could be made from any suitable material. Examples of suitable materials include a metal with a black oxide coating, chrome plated steel, non-spark beryllium, or non-magnetic materials.

The flexible connection 105 joins the first coupling 101 to the second coupling 103. Preferably, the flexible connection 105 is a chain. The present invention could, however, use other flexible connections. For example, the flexible connection 105 could be a vinyl coated braided steel cable (not shown) or laminated sheet stock (not shown).

Pivot pins 107, 109 each extend through a respective coupling 101, 103 and respective opposite ends of the flexible connection 105. The pivot pins 107, 109 rigidly secure the couplings 101, 103 to the flexible connection 105. The pivot pins 107, 109 do, however, allow the flexible connection 105 to rotate relative to the couplings 101, 103.

Several benefits arise when securing the couplings 101, 103 to the flexible connection 105 in such a manner. The first benefit of the present invention is the ability of the flexible connection 105 to limit the rotation of the first coupling 101 relative to the second coupling 103. The pivot pins 107, 109, in combination with the chain, does not allow gross rotation of the first coupling 101 relative to the second coupling 103. This feature frees up one arm of the operator. The operator no longer needs to counteract the torque on the second fastener with the hand wrench W applied to the second fastener. The device 100 of the present invention, by itself, counteracts the torque.

The second benefit of the present invention is the ability of the chain to allow slight rotation of the first coupling 101 relative to the second coupling 103. Some rotation is necessary since the orientation of the first fastener can vary relative to the second fastener. Without this slight flexibility, the device 100 may not be able to mount to the first and second fasteners on the engine 10.

The present invention preferably utilizes the inherent flexibility of the chain to allow slight rotation of the first coupling 101 relative to the second coupling 103. The amount of flexibility should account for the maximum possible orientation difference between the first fastener and the second fastener. For example, the present invention should allow the first coupling 101 to rotate approximately 15° relative to the second coupling 103 when utilizing the aforementioned 12-point fasteners (maximum orientation difference $=\frac{1}{2}\times(360°/12)=15°$).

The present invention could allow a greater rotational allowance by lengthening the chain. Likewise, the present invention could reduce the rotational allowance by shortening the chain. Other techniques are also possible. For example, the openings in the sockets could be elongated slots (not shown), allowing the pivot pins 107, 109 to slide within the slots. Of course the length of the slot would correspond to the desired rotational allowance. Alternatively, the operator could insert at rigid bar (not shown) into two chain links to limit rotation further.

The third benefit of the present invention is the ability of the flexible connection 105 to accommodate engines of various having different spacings S. The only limit to the number of engines on which the operator could use the present invention is the length of the chain. As long as the length of the chain exceeds the spacing S of the target engine, the operator could use the present invention. A side benefit of this feature is the ability for the device 100 to collapse for easy storage.

The fourth, and final, benefit of the present invention is the ability for the operator to loosen or to tighten the fasteners with one hand. Once the operator mounts the device 100 to the first and second fasteners, the operator no longer needs to touch the device. The operator can tighten or loosen the pair of fasteners with one hand. In fact, the device 100 allows the operator to tighten two pairs of fasteners without removing the device 100 from the first and second fasteners.

Figure 5:
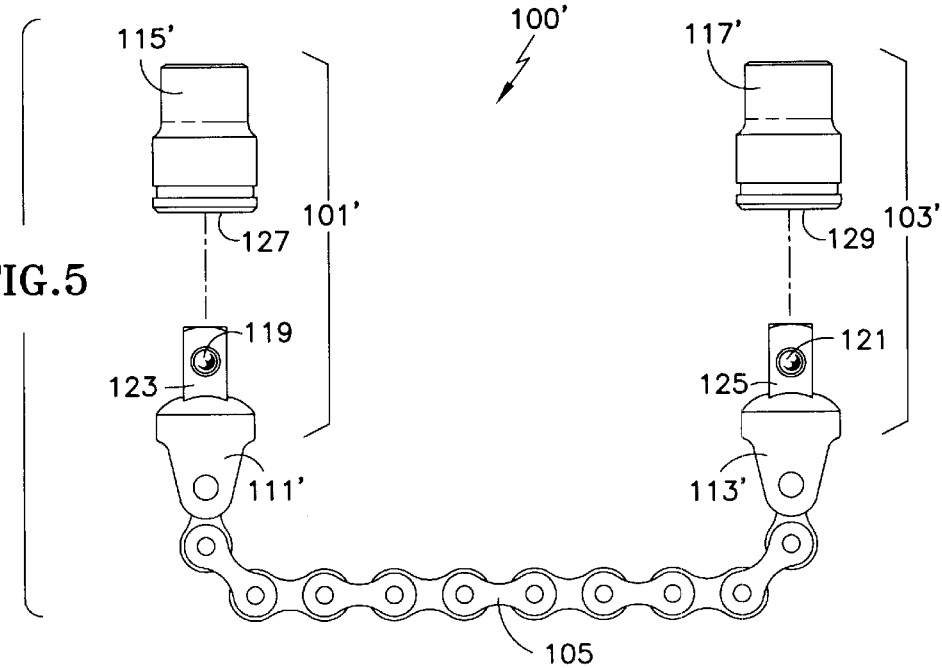
FIG. 5 is a side view of another alternative embodiment of an anti-rotation device of the present invention.

FIG. 5 displays an alternative embodiment of the present invention. The device 100' uses some features from the aforementioned embodiment (such as the flexible connection 105). Differently, the device 100' has different first and second couplings 101', 103'. Specifically, the first and second couplings 101', 103' could have adapters 111', 113' secured to the flexible connection in a manner similar to the aforementioned device 100. The first and second couplings 101', 103' also have sockets 115', 117' removably mountable to the adapters 111', 113'.

To allow removal of the sockets 115', 117', the adapters 111', 113' each include spring-loaded ball bearings 119', 121' located on a post 123', 125' extending away from the flexible coupling 105. The posts 123', 125 extend into corresponding openings 127', 129' in the sockets 115', 117'.

This allows the operator to utilize the device 100' with an even wider array of engines or engine components. With the adapters 111', 113', the operator can use the device 100' on any type of fastener capable of receiving a socket 115, 117'. Since the device 100' could have a different socket at each end, the operator could use the device 100' on any application that uses an array of different fastener types.

Figure 6A:
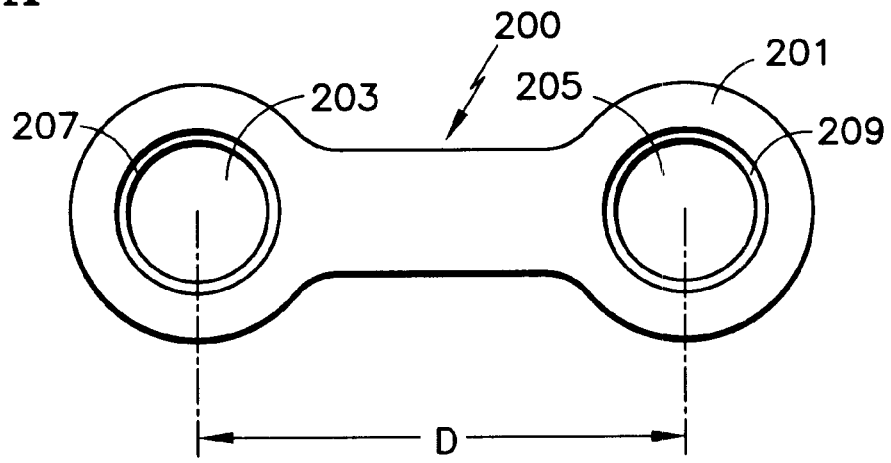
FIGS. 6A and 6B are plan views of two embodiments of a holder for receiving the anti-rotation device of the present invention.
Figure 6B:
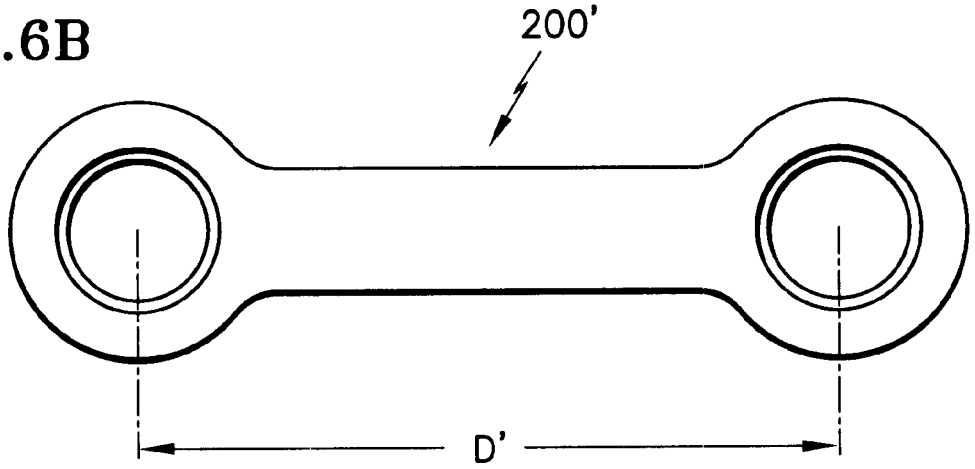

FIG. 6 an additional component of the present invention. The figure displays a holder 200. The holder 200 includes a body 201 made from a suitable material, such as plastic. Opposite ends of the body 201 include openings 203, 205. Preferably, the openings 203, 205 are sized to receive corresponding sockets from the device 100, 100'.

The openings 203, 205 have a centerline spacing D which corresponds to the spacing S of the fasteners on the engine 10. This allows the operator to place the device 100, 100' on the first and second fasteners more rapidly.

In order to help retain the sockets, the holder 200 could include retainers within the openings 203, 205. Although any suitable retainer could be used, the holder 200 preferably has O-rings 207, 209 placed within annular grooves (not shown) in the openings 203, 205. The O-rings 207, 209 preferably receive the sockets in an interference fit.

FIG. 6 also shows a second holder 200'. The second holder, while capable of receiving the same sockets, has a different centerline spacing D' than the other holder 200. Likewise, the second holder 200' allows the operator to place the device 100, 100' on the first and second fasteners of a different engine more rapidly.

In order to differentiate between the different sizes, the holders 200, 200' could each have an identifier which corresponds to the target engine. For example, the holders 200, 200' could be color coded. Other identifiers, such as alphanumeric characters, could be used.

Although described with reference to fasteners located on case flanges of a gas turbine engine, the present invention could be used with fasteners on any application. Such applications include pipelines, aircraft, boilers, heat exchangers and automobiles.

The present invention has been described in connection with the preferred embodiments of the various figures. It is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An anti-rotation device for preventing rotation of a fastener when tightening or loosening another fastener thereon, comprising:

a first coupling for engaging a first fastener, said first fastener being an N-pointed fastener and rotatable about a first axis;

a second coupling for engaging a feature located near said first fastener; and a flexible connection between said first and second couplings;

wherein said flexible connection limits gross rotation of said first coupling relative to said first axis when tightening or loosening another fastener to said first fastener, but allows fine rotation of said first coupling up to an angle of approximately ½ (360°/N) relative to said first axis to allow said first coupling to engage said first fastener at a plurality of orientations.

2. The anti-rotation device as recited in claim 1, wherein said flexible connection comprises a chain.

3. The anti-rotation device as recited in claim 1, wherein at least one of said first and second couplings comprises a socket.

4. The anti-rotation device as recited in claim 1, wherein at least one of said first and second couplings comprises an adapter secured to said flexible connection and a socket removably mountable to said adapter.

5. The anti-rotation device as recited in claim 1, wherein said angle is approximately 15°.

6. A kit for preventing rotation of a fastener, comprising:

an anti-rotation device, including:

a first coupling for engaging a first fastener; and a second coupling for engaging a second fastener located a distance from the first fastener, said second coupling flexibly connected to said first coupling; and at least one holder, including:

a first opening for receiving said first coupling;

a second opening for receiving said second coupling;

wherein a spacing between said first and second openings corresponds to the distance between said first fastener and said second fastener;

wherein said second coupling limits rotation of said first coupling.

7. The kit as recited in claim 6, wherein said at least one holder comprises a plurality of holders, each holder having a different spacing between said first and second openings.

8. The kit as recited in claim 7, wherein each of said holders has an identifier to designate said spacing between said first and second openings.

9. The kit as recited in claim 8, wherein said identifier comprises a color of said holder.

10. The kit as recited in claim 6, wherein said holder further comprises a retainer within said first and second openings.

11. The kit as recited in claim 10, wherein said retainer comprises an O-ring.

12. A method of preventing rotation of a fastener, comprising the steps of:

placing a first coupling on a first fastener, said first fastener being an N-pointed fastener;

placing a second coupling on a feature located near said first fastener, said second coupling flexibly connected to said first coupling so that said couplings can engage said first fastener and said feature at a plurality of orientations;

tightening or loosening a third fastener corresponding to said first fastener; and limiting rotation of said first coupling up to an angle of approximately ½ (360°/N) during the third fastener tightening or loosening step.

13. The method as recited in claim 12, wherein the connecting step uses a chain.

14. The method as recited in claim 12, wherein said angle is approximately 15°.

15. The method as recited in claim 12, wherein the feature comprises a second fastener.

16. The method as recited in claim 15, further comprising the steps of:

tightening or loosening a fourth fastener corresponding to said second fastener; and preventing rotation of said second coupling during the fourth fastener tightening or loosening step.

17. The method as recited in claim 16, wherein the second coupling rotation preventing step occurs without removing said second coupling from said second fastener.

18. The method as recited in claim 17, wherein the second coupling rotation preventing step occurs without removing said first coupling from said first fastener.

19. An anti-rotation device for preventing rotation of a fastener when tightening or loosening another fastener thereon, comprising:

a first coupling for engaging a first fastener rotatable about a first axis;

a second coupling for engaging a feature located near said first fastener; and a chain between said first and: second couplings;

wherein said chain limits gross rotation of said first coupling relative to said first axis when tightening or loosening another fastener to said first fastener, but allows fine rotation of said first coupling relative to said first axis to allow said first coupling to engage said first fastener at a plurality of orientations.

* * * * *